US006841749B1

(12) United States Patent
Radosavljevic et al.

(10) Patent No.: US 6,841,749 B1
(45) Date of Patent: Jan. 11, 2005

(54) SLIDE SWITCH FOR FAN CONTROL

(75) Inventors: Dejan Radosavljevic, LaFayette, NY (US); Kenneth Vought, Tully, NY (US)

(73) Assignee: Pass + Seymour, Inc., Syracuse, NY (US)

( * ) Notice: Subject to any disclaimer, the term of this patent is extended or adjusted under 35 U.S.C. 154(b) by 612 days.

(21) Appl. No.: 09/732,120

(22) Filed: Dec. 7, 2000

(51) Int. Cl.[7] ..... H01H 15/00
(52) U.S. Cl. ..... 200/550
(58) Field of Search ..... 200/549, 550, 200/16 D

(56) References Cited

U.S. PATENT DOCUMENTS 2,762,880 A * 9/1956 Hawthorn et al. ..... 200/550
4,057,520 A * 11/1977 Schwartz ..... 200/550
4,152,565 A 5/1979 Rose
4,408,150 A 10/1983 Holston et al.
5,191,971 A 3/1993 Hakkarainen et al.
5,293,103 A 3/1994 Hanna
5,365,028 A * 11/1994 Takano ..... 200/549 X
5,657,861 A * 8/1997 Takano et al. ..... 200/550
5,685,419 A 11/1997 Takano

* cited by examiner

*Primary Examiner*—Renee Luebke
(74) *Attorney, Agent, or Firm*—Daniel P. Malley; Bond, Schueneck + King

(57) ABSTRACT

A slide switch includes a glider constrained by a housing which is mounted on a printed circuit board (PCB). Dual contact springs on the bottom of the glider interact with two rows of contacts on the PCB, with each contact spring making contact between adjacent contacts in the same row as the contact spring. In the preferred embodiment, the switch is a dual pole five-throw position switch which in conjunction with the circuit on the PCB, provides speed control for a fan with four speed settings and an OFF setting. If n number of contact springs and k number of contacts are in each row, an n-pole k-l throw linear switch is possible.

6 Claims, 4 Drawing Sheets

SWITCH OPERATION

| SPEED SETTING | CONTACT CONNECTIONS |
|---|---|
| OFF | 1/2 , 11/12 |
| LOW1 | 2/3 , 10/11 |
| LOW2 | 3/4 , 9/10 |
| MEDIUM | 4/5 , 8/9 |
| HIGH | 5/6 , 7/8 |

SLIDE SWITCH FOR FAN CONTROL

FIELD OF THE INVENTION

The invention relates to the field of manually actuated slide switches with internal circuitry, and in particular to a slide switch and associated circuitry that removes the humming noise produced by a ceiling fan unit.

BACKGROUND OF THE INVENTION

Traditionally ceiling fans have a feedback noise known as hum. Switching devices which reduce or eliminate the hum are generally limited in their selection of speeds and lack a smooth feeling action that provides a good tactile feel.

U.S. Pat. No. 5,191,971 (Hakkarainen et al.) entitled MULTI-POSITION WALL MOUNTABLE CONTROL SWITCH WITH TACTILE FEEDBACK LINEAR ACTUATOR discloses a linear slide switch that uses a wheel having a conductive axle. The positions of the switch are determined by a series of detents, one for each switch position. The wheel breaks contact when between detents and makes contact when seated within a detent.

U.S. Pat. No. 4,152,565 (Rose) entitled BCD SLIDE-SWITCH discloses a switch housing carriage with contact projections that make contact between contact strips on a base portion. The carriage is supported by two balls on either end of a transverse spring. The positions of the switch are determined by a series of detents in the side wall of the base portion.

U.S. Pat. No. 5,293,103 (Hanna) entitled QUIET FAN SPEED CONTROL WITH LINEAR ADJUSTMENT ACTUATOR discloses a linear slide switch that is positionable at each of four discrete positions to connect various capacitances in series with a fan motor. Detents in an actuator engaging the slide switch urge the switch into each of the four positions.

U.S. Pat. No. 5,685,419 (Takano) entitled LEVER SWITCH discloses a lever switch that has a movable contact piece at one end of the operating lever that moves between two positions.

U.S. Pat. No. 4,408,150 (Holston et al.) entitled SPEED CONTROL SYSTEM AND METHOD FOR ELECTRIC MOTOR discloses a capacitor interconnected in series with one of several main windings of a motor. A multi-position switch permits serially connecting the capacitor to the main windings to operate the motor at less than its normal operating speed.

SUMMARY OF THE INVENTION

Briefly stated, a slide switch includes a glider constrained by a housing which is mounted on a printed circuit board (PCB). Dual contact springs on the bottom of the glider interact with two rows of contacts on the PCB, with each contact spring making contact between adjacent contacts in the same row as the contact spring. In the preferred embodiment, the switch is a dual pole five-throw position switch which in conjunction with the circuit on the PCB, provides speed control for a fan with four speed settings and an OFF setting. If n number of contact springs and k number of contacts are in each row, an n-pole k-l throw linear switch is possible.

According to an embodiment of the invention, a slide switch for a circuit on a circuit board includes a housing connected to the circuit board; a glider slidably fitting inside the housing with a portion of the glider extending outside the housing; at least one contact spring connected to the glider; the at least one contact spring oriented in a direction substantially parallel to a direction of travel of the glider in the housing; the at least one contact spring having a projection extending away from the glider; the circuit board including a plurality of contacts on one side thereof, the plurality of contacts being arranged in at least one row extending substantially in the orientation direction of the at least one contact spring; and the plurality of contacts being spaced apart such that the projection of the at least one contact spring forms a detent fit in a space between each pair of adjacent contacts in the at least one row, and a portion of each the at least one contact spring makes electrical contact with the pair of adjacent contacts when the projection forms the detent fit, thereby forming an electrical connection between the pair of adjacent contacts in the at least one row.

DETAILED DESCRIPTION OF THE PREFERRED EMBODIMENT

Figure 1:
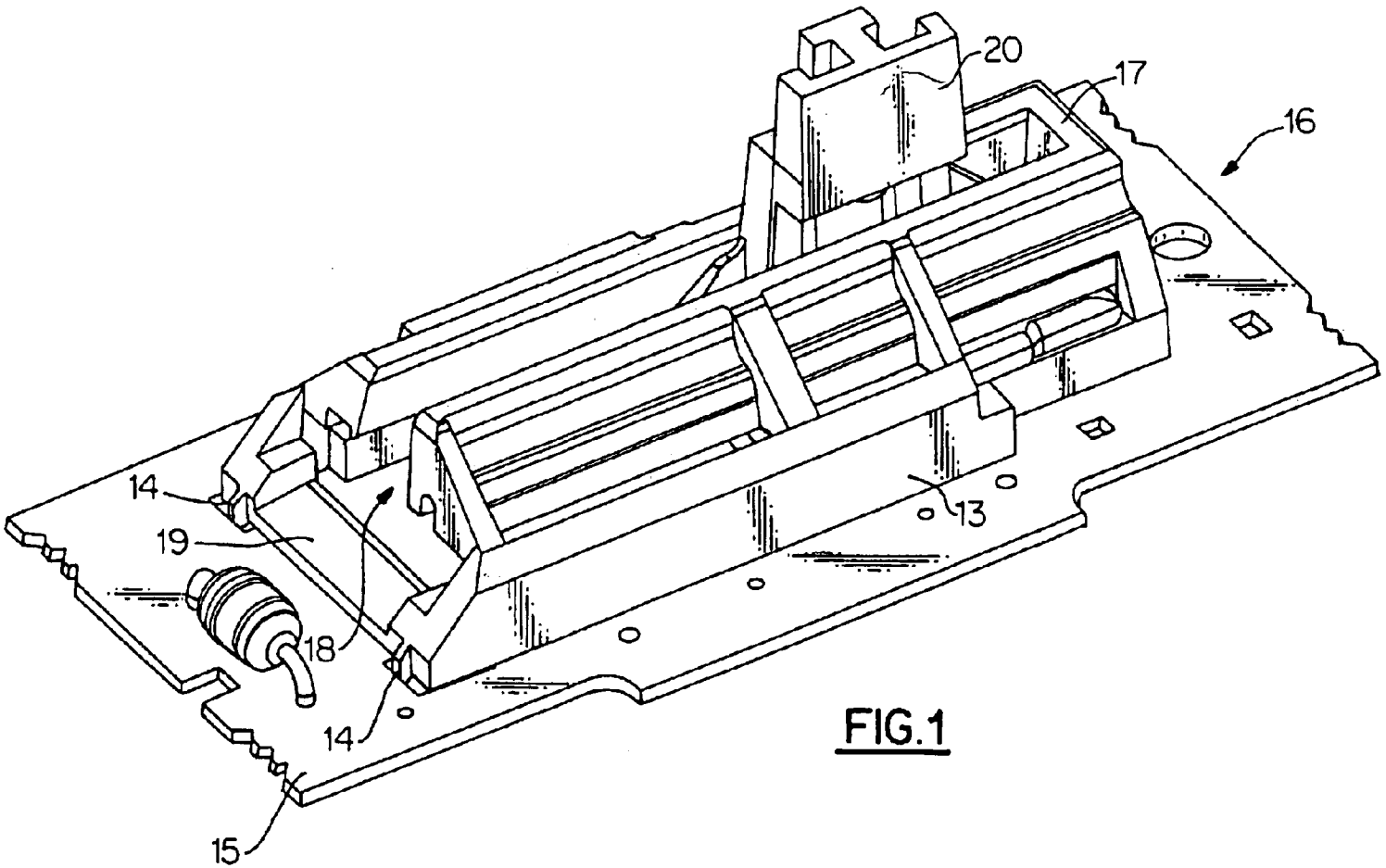
FIG. 1 shows a slide switch according to an embodiment of the present invention.
Figure 2:
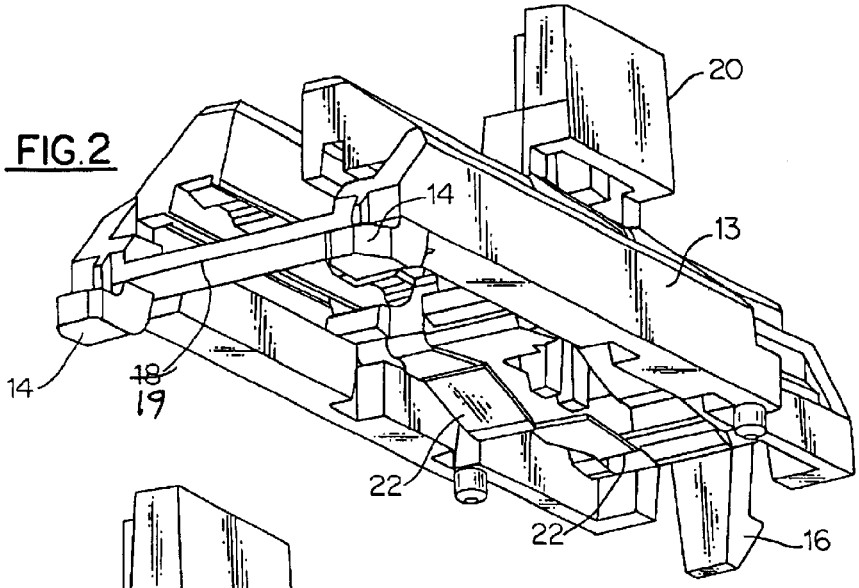
FIG. 2 shows an embodiment of a housing and glider according to the present invention.

Referring to FIGS. 1–2, a slide switch housing 13 is preferably connected to a circuit board 15 by two latches 14 at one end of housing 13 and a single centered latch 16 at the other end of housing 13. During assembly, latches 14 are inserted while housing 13 is canted with respect to circuit board 15, after which housing 13 is rotated downwards toward circuit board 15 and latched into place with latch 16. Housing 13 is preferably one-piece and made of plastic. Housing 13 includes end wall 17 and an opening 18. Opening 18 permits the insertion of glider 20 into housing 13. A cross-piece 19 acts as an end stop for glider 20 and adds strength to housing 13 across open end 18. Glider 20 slidably fits inside housing 13 and is moveable back and forth therein.

Figure 3:
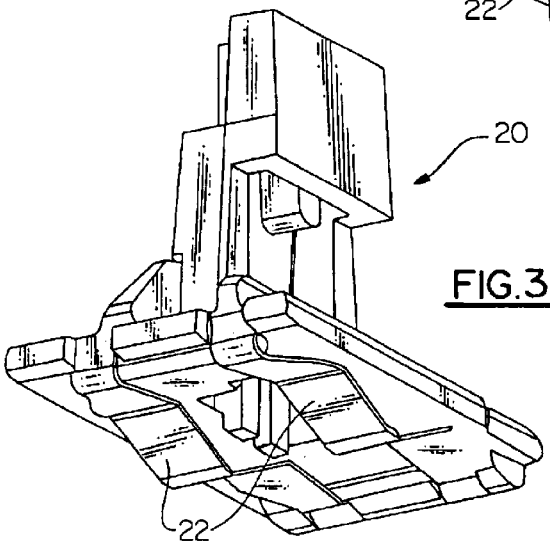
FIG. 3 shows an embodiment of the glider of the slide switch of the present invention.

Referring to FIG. 3, glider 20 includes a set of symmetrical contact springs 22 on an underside thereof. Moving glider 20 thus moves contact springs 22. Glider 20 is preferably of one-piece plastic and preferably shaped to be manufactured using injection techniques.

Figure 4:
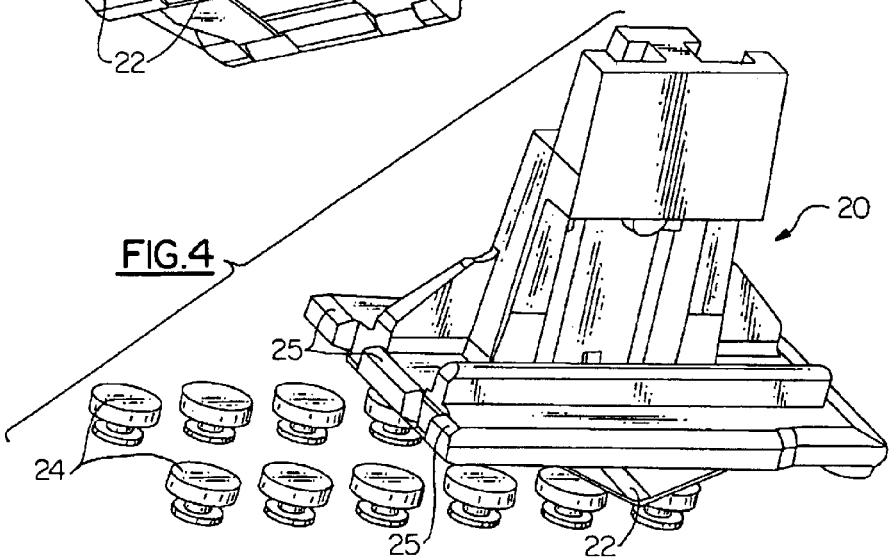
FIG. 4 shows an embodiment of the glider of the present invention positioned along two rows of contacts.

Referring to FIG. 4, the leading edges of glider 20 are chamfered at 25 to allow a smooth glide as glider 20 is moved back and forth within housing 13. Glider 20 provides positioning for the set of contact springs 22 symmetrically in place over two rows of contacts 24, preferably of silver, that are directly fixed to circuit board 15. Contact springs 24 are allowed to detent (snap) themselves in place between the circuit board contacts 24, making electrical connection at each position as glider 20 moves the springs 22 along the row of contacts. The amount of incline (pressure angle) at the contact surface between the springs 22 and board 15 provides a smooth cam action with a positive tactile feel as glider 20 traverses across contacts 24. Glider 20 is preferably assembled with housing 13 using dampening grease.

Figure 5:
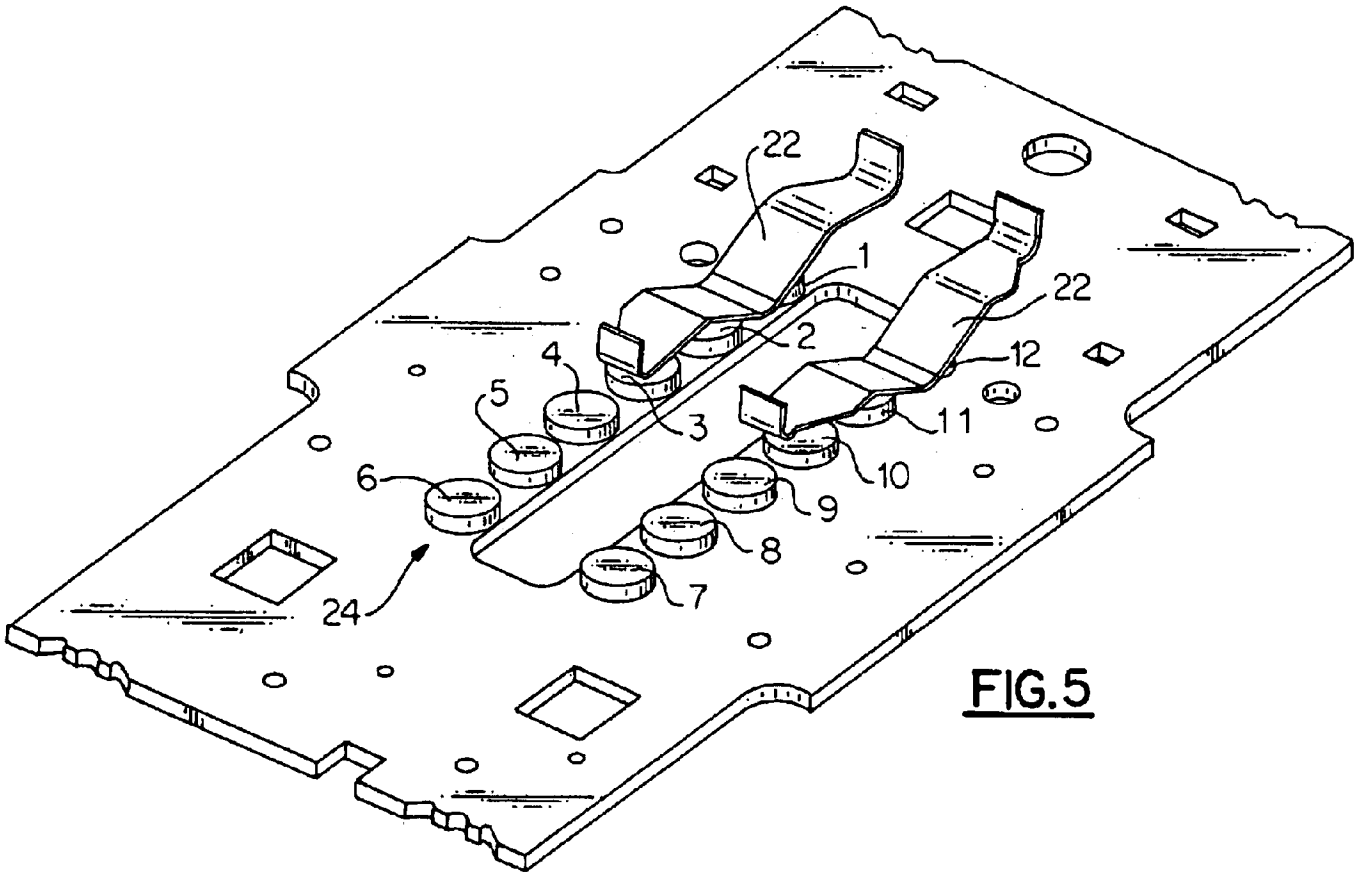
FIG. 5 shows two leaf springs of the glider of the present invention positioned along two rows of contacts on a circuit board.

Referring to FIG. 5, springs 22 are shown connecting two adjacent contacts 24 in the same row. Contacts 1 through 12 are shown in the figure, although more or fewer could be used depending on the precise use. Specifically, as shown in the figure, contacts 11 and 12 are electrically connected by one spring 22, while the other spring 22 electrically connects contacts 1 and 2. The labeling of contacts 1–12 corresponds to the schematic of FIG. 6.

Thus, a positive detent five position electrical switch is disclosed which has friction (interaction) on the contacts only between circuit board contacts 1–12 and contact springs 22 on glider 20. Contact springs 22 are part of the switching mechanism that are also the detent. This omits the need for an additional detent mechanism as shown in the prior art, that is, separate springs, balls and specific details and parts manufactured for such purposes.

Figures 6, 7:
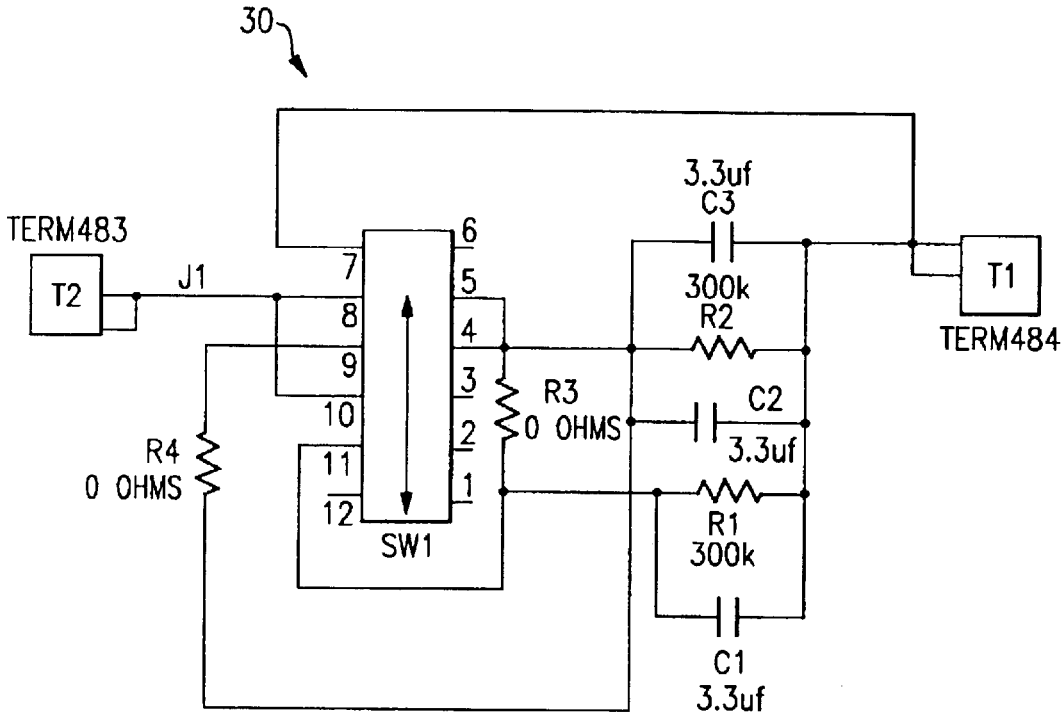
FIG. 6 shows a schematic of a four-speed de-hummer circuit for a ceiling fan that uses the slide switch of the present invention.
FIG. 7 shows the switch operation of the circuit of FIG. 6 as the slide switch of the present invention is in each of five positions.

Referring to FIG. 6, a circuit 30 is shown for a 4-speed de-hummer that controls a paddle fan such as a ceiling fan. In essence, the inductive reactance of the fan and the capacitive reactance of the circuit form a voltage divider. Circuit 30 cooperates with the switch by increasing the capacitance of the circuit when the switch is in different positions. Terminal T2 is connected to a conventional power source such as a 120 Volt 60 Hz power source as used in the United States. The present invention also works with other conventional AC power sources of different voltages and frequencies. Terminal T1 is connected to the fan. Resistors R3 and R4 are shown as zero ohm resistors, and represent jumper connections that are not part of the printed circuit board's normal wiring due to manufacturing considerations.

Referring also to FIG. 7, the switch speed settings and their associated contact connections are shown. When the fan is off, contacts 11 and 12 are connected, as are contacts 1 and 2. Since contacts 1 and 2 are not connected to anything, they don't affect the circuit. Contact 12 also isn't connected to anything and thus does not affect the circuit. Since no circuit is completed, the fan is OFF. In the "Low1" setting, contacts 10 and 11 are connected, as are contacts 2 and 3. Contacts 2 and 3 are not connected to anything and do not affect the circuit. Connecting contacts 10 and 11 connects the power source to the fan via a parallel combination of resistor R1 and capacitor C1. Resistor R1 is not essential to the circuit, but acts to bleed off the voltage capacitor C1 is switched out of the circuit.

At the "Low2" switch setting, contacts 9 and 10 are connected, as are contacts 3 and 4. Since contact 3 is not connected to anything, the connection of contacts 3 and 4 does not affect the circuit. Connecting contacts 9 and 10 provides power to the fan via the parallel combination of resistor R2 and capacitors C2 and C3. Capacitors C2 and C3 are preferably identical in size to capacitor C1 for manufacturing reasons, but could be made as a single capacitor. At the "Medium" switch setting, contacts 8 and 9 are connected, as are contacts 4 and 5. Connecting contacts 8 and 9 brings the R2-C2-C3 combination into the circuit, while connecting contacts 4 and 5 brings the R1-C1 combination into the circuit. At this setting, there is three times as much capacitance in the circuit as with the Low1 switch setting. Finally, at the "High" switch setting, connecting contacts 7 and 8 simply applies full power to the fan, while the connection of contacts 5 and 6 doesn't affect the circuit.

As can be seen from the embodiment shown in FIGS. 6–7, the slide switch of the present invention can be used with a wide range of different circuit designs. For example, if there is only one contact spring 22 and only one row of contacts 24, a single pole switch is formed. If there are two contact springs 22 and two rows of contacts 24, a double pole switch is formed. If there are n number of contact springs 22 with a corresponding number of rows of contacts 24, an n-pole switch is formed. The number of possible "throw" positions of the switch correspond to one less than the number of contacts in each row. That is, if there are k number of contacts in each row, there are k-l positions that glider 20 can be in. For example, in the 2-pole switch of FIG. 6, there are six contacts in each row, resulting in a five position switch (four speed setting positions and one OFF position). The invention thus permits constructing an n-pole k-l throw linear switch.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A slide switch for a circuit on a circuit board, comprising:

a housing connected to said circuit board;

a glider slidably fitting inside said housing with a portion of said glider extending outside said housing;

at least one contact spring connected to said glider;

said at least one contact spring oriented in a direction substantially parallel to a direction of travel of said glider in said housing;

said at least one contact spring having a projection extending away from said glider;

said circuit board including a plurality of contacts on one side thereof, said plurality of contacts being arranged in at least one row extending substantially in said orientation direction of said at least one contact spring; and said plurality of contacts being spaced apart such that said projection of said at least one contact spring forms a detent fit in a space between each pair of adjacent contacts in said at least one row, and a portion of each said at least one contact spring makes electrical contact with said pair of adjacent contacts when said projection forms said detent fit, thereby forming an electrical connection between said pair of adjacent contacts in said at least one row.

2. A switch according to claim 1, wherein said circuit includes:

a first terminal connectable to an AC power source;

a second terminal connectable to a fan motor, said switch having a first position where no electrical connection is made between said first and second terminals;

said switch having a second position where an electrical connection is made between said first and second terminals through a capacitor; and said switch having a third position where an electrical connection is made directly between said first and second terminals.

3. A switch according to claim 1, wherein a number of rows equals a number of contact springs.

4. A switch according to claim 3, wherein said number of rows and contact springs is two.

5. A switch according to claim 4, wherein each row has six contacts and said switch has five positions.

6. A switch according to claim 5, wherein said circuit includes:

a first terminal connectable to an AC power source;

a second terminal connectable to a fan motor;

said switch having a first position where no electrical connection is made between said first and second terminals;

said switch having a second position where an electrical connection is made between said first and second terminals through a first capacitance;

said switch having a third position where an electrical connection is made between said first and second terminals through a second capacitance;

said switch having a fourth position where an electrical connection is made between said first and second terminals through a parallel combination of both said first and second capacitances; and said switch having a fifth position where an electrical connection is made directly between said first and second terminals.

* * * * *